United States Patent [19]

Sundles et al.

[11] Patent Number: 4,628,877

[45] Date of Patent: Dec. 16, 1986

[54] VEHICLE COLD START SYSTEM

[75] Inventors: Timothy B. Sundles; M. Wayne Brown, both of San Jose, Calif.

[73] Assignee: Lubrication Research, Inc., San Jose, Calif.

[21] Appl. No.: 754,008

[22] Filed: Jul. 11, 1985

[51] Int. Cl.[4] ..... F01M 1/00

[52] U.S. Cl. ..... 123/196 S; 123/198 C; 123/179 B; 123/179 A

[58] Field of Search ..... 123/196 S, 198 C, 196 R, 123/196 A, 179 A, 179 B

[56] References Cited

U.S. PATENT DOCUMENTS

| | | | |
|---|---|---|---|
| 2,178,756 | 11/1939 | Joost | 123/196 S |
| 2,273,888 | 2/1942 | Paulsen | 123/196 S |
| 2,526,197 | 10/1950 | Cannon et al. | 123/196 S |
| 2,747,564 | 5/1956 | Wehling | 123/196 S |
| 4,157,744 | 6/1979 | Capriotti | 123/196 S |
| 4,453,511 | 6/1984 | Pluequet | 123/196 S |
| 4,513,705 | 4/1985 | Evans | 123/196 S |
| 4,531,485 | 7/1935 | Murther | 123/196 S |

FOREIGN PATENT DOCUMENTS

| | | | |
|---|---|---|---|
| 1154974 | 9/1963 | Fed. Rep. of Germany | 123/196 S |

*Primary Examiner*—E. Rollins Cross

*Attorney, Agent, or Firm*—Thomas E. Schatzel

[57] ABSTRACT

A lubrication system for internal-combustion engines having a mechanical-type oil pump and turbocharger. The system includes an auxiliary electrically operated oil pump, a first time-delay relay connected to the ignition system to energize the electrically operated oil pump for a first time period after the ignition is turned on to prelubricate the engine, and a second time-delay relay to energize the electrically operated pump for a second period after the ignition is turned off to lubricate the turbocharger.

6 Claims, 2 Drawing Figures

VEHICLE COLD START SYSTEM

BACKGROUND OF INVENTION

1. Field of the Invention

The present invention relates to lubrication systems for internal-combustion engines and, more particularly, to lubrication systems for such engines and turbochargers.

2. Description of the Prior Art

Workers in the art of internal-combustion engines have long tried to minimize wear on the engines. For example, substantial efforts have been made to improve lubricants for the engines, and to provide improved bearings and lubrication systems.

It is well known in the automotive art that wear in automobile and other vehicle engines of the internal-combustion type is not simply related to the number of miles driven, but depends upon the conditions under which the vehicle is driven. For example, it is recognized that an engine of a vehicle which is utilized for frequent short trips will wear faster (on a per-mile basis) than the engine of a vehicle which is driven less frequently but longer distances. This difference in wear life can be explained, at least in part, by the fact that friction is at its maximum value during the first few minutes after a cold engine is started and that, after the engine has warmed to its normal operating temperature, friction within the engine drops substantially. Some workers in the automotive art have estimated that up to ninety percent (90%) of the total mechanical wear of an engine occurs within a relatively short time after starting the engine cold. In one article on this subject, workers in the art estimated that an automobile engine undergoes the same amount of mechanical wear during the first thirty seconds after it is started cold as the engine would undergo if driven fully warm for five hundred miles. In otherwords, according to this source, the wear during a thirty second cold start of an engine may equal approximately the wear undergone by a fully warm engine over a nine hour period of normal operation. Similarly, The Society of Automotive Engineers has determined that up to eighty percent of the wear on vehicle engines occurs during the first ten seconds of operation. Accordingly, it is clear that critical times for engine wear occur during the period that the engine is being cranked by the starter motor and before the mechanical oil pump of the engine has had sufficient time to fill the oil galleys of the engine with oil at the normal operating pressure.

To overcome such frictional wear during cold starting of an automobile engine, prior art workers have provided reservoir systems which are filled and pressurized with oil while the engine is operating and which hold the oil under pressure during the period the engine is off, and then release the oil to the engine just as the engine is restarted. The difficulty with such reservoir systems is that relatively high pressures are required and leakage normally occurs during the period that the engine is off, thereby causing the pressurized reservoir system to lose its effectiveness.

Similar pressurized reservoir systems have been employed with engines equipped with turbochargers. The wear associated with typical turbochargers normally occurs because, after an engine is shut off, the turbocharger may continue to rotate at 75,000 to 5,000 rpm for a period of time after the mechanical oil pump for the engine has been shut off. To prevent undue wear of the rotating parts of the turbocharger, it has been proposed to utilize a pressurized oil reservoir of the type described above which discharges to the turbocharger whenever the engine is shut off, and then is recharged after the engine begins operation.

SUMMARY OF THE INVENTION

A general object of the present invention is to provide a system to minimize frictional wear of an engine of the internal-combustion type.

More particularly, an object of the present invention is to provide a system to minimize frictional wear of an engine of the internal combustion type having a mechanical-type oil pump during the period of and following a cold start of the engine.

Another object of the present invention is to provide a system which, in addition to minimizing frictional wear of an engine during the period of and following cold starts, also provides lubrication to a turbocharger after the engine has been shut off.

In accordance with the preceding objects, the present invention provides a system for lubrication of an engine prior to starting the engine comprising an electrically operated oil pump connected between the oil sump of the engine and the oil galleys of the engine; an electrical time-delay relay connected to the ignition system to energize the oil pump for a predetermined time period after the ignition is turned on and, thereafter, to de-energize the oil pump; a one-way valve to prevent back flow of oil into the pressurized oil outlet of the pump; and a bypass for connecting the pressurized oil outlet of oil pump to its inlet when the one-way valve is closed or the pump discharge is otherwise restricted. In one modification, the system further includes a second conduit connecting the oil pump outlet in oil-flow communication with a turbocharger for the engine and a second time-delay relay connected to the ignition and battery system of the engine and to the motor of the pump to allow battery current to energize the pump for a predetermined period after the ignition is turned off.

Accordingly, an advantage of the present invention is the provision of a system to minimize frictional wear of an engine of the internal-combustion type having a mechanical type oil pump.

Another advantage of the present invention is the provision of a system to minimize frictional wear of an engine of the internal combustion type during the period of and following a cold start of the engine.

Still another advantage of the present invention is the provision of a system which, in addition to minimizing frictional wear of an internal-combustion engine during the period of and following cold starts, also provides lubrication to a turbocharger after the engine has been shut off.

These and other objects and advantages of the present invention will no doubt become obvious to those of ordinary skill in the art after having read the following detailed description of the preferred embodiments which are illustrated in the various drawing figures.

IN THE DRAWINGS

FIG. 1 is a functional diagram of a mechanical system according to the present invention; and FIG. 2 is a functional diagram of an electrical system for usage with, and control of, the mechanical system of FIG. 1.

DETAILED DESCRIPTION OF THE PREFERRED EMBODIMENT

Figure 1:
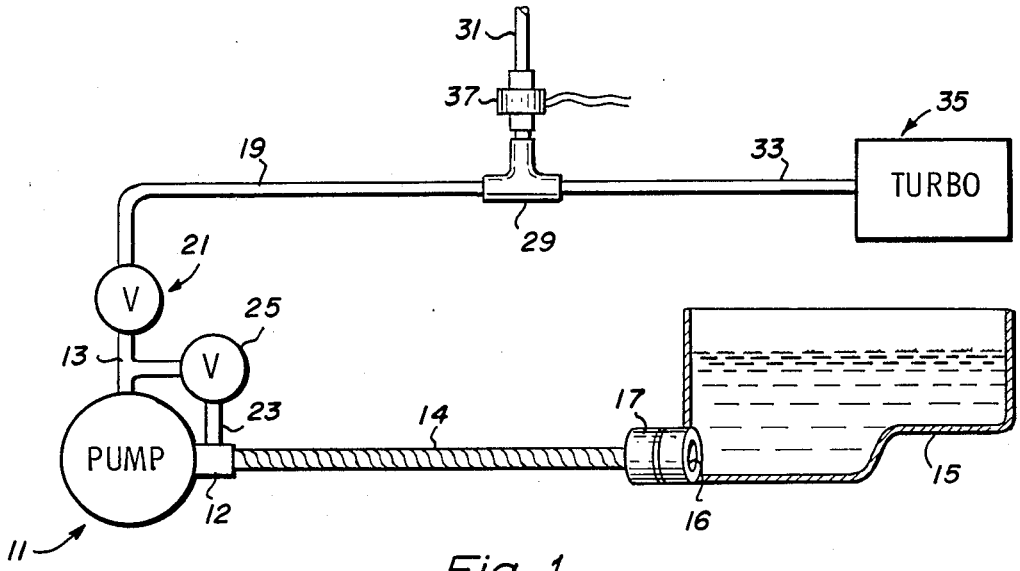

In the system of FIG. 1, reference number 11 generally designates an electrically operated positive displacement oil pump having an inlet 12 and a pressurized oil outlet 13. The inlet 12 is connected, via a suction hose 14, to an oil sump 15 of an internal-combustion engine (not shown) of the type utilized on vehicles. More particularly, the suction hose 14 is connected into an aperture 16 formed in the lower portion of the sump 15 at a location which is normally submerged in the reservoir of lubricating oil held in the sump. In practice, the suction hose 14 is connected into the aperture 16 via a self-closing connection device 17 as is commercially available from various sources.

Referring still to FIG. 1, the pressurized oil outlet 13 of the oil pump 11 is connected to a conduit 19 via a normally-closed one-way check valve 21 which prevents back-flow of oil from the conduit 19 into the pump 11. Further, the pump 11 includes bypass means, schematically illustrated as a conduit 23 having a pressure relief valve 25 interposed therein to allow flow directly from the outlet 13 to the inlet 12 at predetermined high pressures, as when the one-way check valve 21 is closed because of high pressures generated by the mechanical-type oil pump of the engine or because of other restrictions. Such pressure relief bypass means can take many forms in practice, and normally is internal to the pump. In practice, the pump 11 provides a maximum output pressure of about one hundred pounds-per-square-inch (psi), and the bypass is set to operate at about thirty to forty psi.

At its opposite end, the conduit 19 is connected, via a fitting 29, to a conduit 31 which carries oil to the galleyways in the engine. In the preferred embodiment, the fitting 29 is a tee whose third leg can be connected to a conduit 33 to carry oil to a turbocharger 35 connected to the engine. In practice, a conventional oil sender unit 37 is interposed between the tee-fitting 29 and the conduit 31 to provide an oil pressure signal to the instrument panel of the vehicle.

Figure 2:
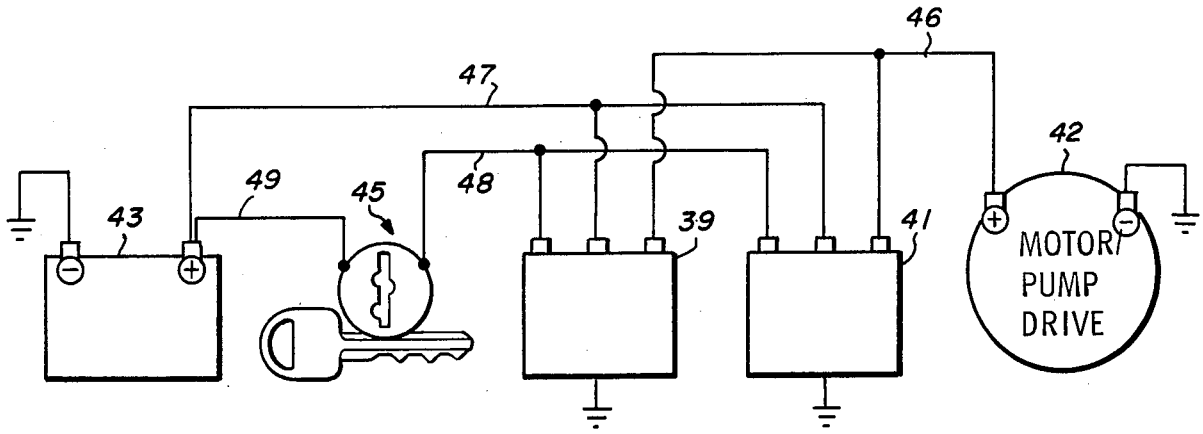

FIG. 2 illustrates a system for controlling operation of the oil pump 11 comprising first and second time-delay relays 39 and 41, respectively, connected to a motor 42 of the oil pump 11 of FIG. 1. The system of FIG. 2 also includes, without modification, the vehicle's battery 43 and the vehicle's ignition switch 45. In the embodiment shown, each of the time-delay relays 39 and 41 have three input terminals. One terminal of each of the relays 39 and 41 is connected, via current conducting wire 46, to the oil pump motor 42; another terminal of each of the time-delay relays is connected directly to the battery 43 via wire 47, and the third terminal of each of the relays is connected to the ignition switch 45 via wire 48. The ignition switch 45 is, in turn, connected to the battery 43 by a wire 49.

The time-delay relays 39 and 41 are conventional components, commercially available from various sources. In the system of FIG. 2, the time-delay relay 39 is of the type which functions to allow electrical power to flow from the battery 43 to the pump motor 42 for a predetermined period of time after the ignition switch 45 is turned to the "on" position. In practice, the relay 39 is set to provide operating current to the motor 42 for about five seconds after the ignition switch 45 is turned on; thereafter, a switch or contacts which are internal of the relay 39 move to an "open" position and prevent current from flowing to the motor 42 through that relay.

By way of contrast to the relay 39, the time-delay relay 41 functions to allow current to flow from the battery 43 to the pump motor 42 for a predetermined time period after the ignition switch 45 is turned to the "off" position. In practice, the relay 41 is set to provide operating current to the motor 42 for at least about twenty seconds after the ignition switch is turned off; thereafter, contacts which are internal to the relay move to an open position and prevent current from flowing to the motor 42 from the battery 43 through the relay 41.

With the above description in mind, the function and operation of the system of FIGS. 1 and 2 can be readily understood. The operation is best understood by first assuming that the ignition switch 45 has been in the "off" position for some extended period of time, and then is placed in the "on" position. When the ignition switch is turned on, current from the battery 43 will flow through the switch 45 to the first time-delay relay 39 via the line 48. This flow of current will energize the relay 39, causing closure of contacts internal to the relay which permit battery power to flow from wire 47 through the relay and then through line 46 to pump 42 for a period of time predetermined by the relay. After expiration of the predetermined time period, the contacts internal of the relay 39 will open, thereby terminating the flow of electrical current to the motor 42. The time-delay relay 39 will not be reactivated until the ignition switch 45 is turned off, and then turned on again. In practice, the relay 39 is rated for about thirty-five amperes at 12 volts DC.

The time-delay relay 41 is optional to the system of FIGS. 1 and 2, and is to be utilized where the engine is equipped with a turbocharger. In such a situation, the relay 41 carries no current to the motor 42 until such time as the ignition switch 45 is placed in the "off" position. At that time, a switch internal of the relay 41 closes for a predetermined period of time, thereby allowing current to flow from the battery 43 to the motor 42 via wires 46 and 47. In practice, the relay 41 operates for a predetermined period of at least about twenty seconds after the ignition is turned off; after expiration of the predetermined time period, the switch internal of the relay 41 will open, thereby preventing the flow of current from the battery 43 to the pump 42. The relay 41 will remain in the open condition until such time as the ignition switch 45 is turned on and then turned off again.

After the ignition switch 45 is placed in the "on" position, it can then be turned to the "start" position. If the elapsed time between placing the ignition switch in the "on" position and the "start" position is greater than the pre-set period of the time-delay relay 39, the relay 39 will automatically function to turn off the motor 42 of the oil pump 11 after expiration of the preset period. If the ignition switch 45 is turned to the "start" position immediately after the "on" position, thereby starting the engine of the vehicle, the motor 42 of the oil pump 11 will continue to operate until expiration of the preset time period of the relay 39. In the event that the oil pressure generated by the mechanical oil pump of the engine of the vehicle exceeds the pressure generated by the pump 11, the one-way check valve 21 will operate to prevent backflow of oil through conduit 19 into the pump 11; simultaneously, the pressure relief valve 25 will operate to bypass oil from the outlet 13 of the pump 11 to the inlet 12.

Workers skilled in the art will recognize that means, such as pressure-activated switches or the like, can be provided to selectively actuate the motor 42 of the pump 11 during the period of operation of the vehicle engine. For example, such a pressure-activated switch could be provided to operate the electrical oil pump in the event the pressure provided by the mechanical-type oil pump associated with the engine fell below a certain predetermined value.

Similarly, workers in the art will recognize that valving systems can be provided in place of tee-fitting *2a* so that oil is selectively directed only to the oil galleys of the engine until the engine is turned off and only to the turbocharger 35 until the engine is turned on. The result of providing such valving would be to reduce the work required of the pump 11, since it would not provide oil to the turbocharger while the engine is being started and, also, would not provide oil to the engine after the engine is turned off.

Although the present invention has been described with particular reference to the illustrated preferred embodiments, it is to be understood that such disclosure is not to be interpreted as limiting. Various other alterations, modifications and embodiments will no doubt become apparent to those skilled in the art after having read the preceding disclosure. Accordingly, it is intended that the appended claims be interpreted as covering all such alterations, modifications and embodiments as fall within the true spirit and scope of the present invention.

We claim:

1. A system for improving lubrication of an internal-combustion engine having an ignition, starter motor, battery system and a mechanical-type oil pump, the system comprising:

an electrically operated oil pump for connection in liquid communication with an oil sump of an engine and havig an electrical motor;

first conduit means for connecting pressurized oil outlet of the oil pump to oil galleys of the engine to establish oil flow communications with said oil galleys;

electrical time-delay relay means for connection to the ignition and battery system of the engine and to said motor of the oil pump to energize motor for a predetermined time period after the ignition is initially turned on but before the starter motor is activated by allowing battery current of the battery system to flow through a contact internal of the relay means to energize said electrical motor and, after said firsr predetermined time period has lapsed, preventing the flow of current through said internal contact;

one-way valve means mounted to the oil pump to prevent back-flow of oil into the pressurized oil outlet; and bypass means connecting the pressurized oil outlet of the oil pump to inlet of the pump when the one-way valve means is closed or flow from said pressurized oil outlet is restricted.

2. A system according to claim 1 further including:

second conduit means for connecting the pressurized oil outlet of the oil pump to oil-flow communication with a turbocharger for the engine; and second electrical time-delay relay means for connection to the ignition and battery system of the engine and to said motor of the oil pump for allowing battery current to flow through a contact internal of said second relay to energize said motor of the oil pump for a second predetermined time period after the ignition switch is turned off and, after said second predetermined time period has elapsed, preventing the flow of current through said internal contact of said second relay.

3. A system according to claim 1 wherein said bypass means allows pumped oil to flow directly from the outlet to the inlet of the pump in the event that oil pressure generated by the mechanical-type oil pump of the engine closes said one-way valve means.

4. A system according to claim 3 wherein said first predetermined time period exceeds about five seconds.

5. A system according to claim 2, wherein said second predetermined time period exceeds about twenty seconds.

6. A system according to claim 1 wherein, said connection between the electrically operated oil pump and said oil sump is comprised of a second conduit means which is not connected to a mechanical oil pump of said engine such that the operation of said mechanical oil pump does not effect the oil flow to the electrically operated oil pump.

* * * * *